US008066072B2

(12) United States Patent
Lumbye

(10) Patent No.: US 8,066,072 B2
(45) Date of Patent: Nov. 29, 2011

(54) METHOD OF STIMULATING A WELL

(75) Inventor: Peter Lumbye, Måløv (DK)

(73) Assignee: Maersk Olie OG Gas A/S, Copenhagen (DK)

( * ) Notice: Subject to any disclaimer, the term of this patent is extended or adjusted under 35 U.S.C. 154(b) by 86 days.

(21) Appl. No.: 12/238,086

(22) Filed: Sep. 25, 2008

(65) Prior Publication Data

US 2009/0114385 A1 May 7, 2009

Related U.S. Application Data

(60) Provisional application No. 60/975,348, filed on Sep. 26, 2007.

(30) Foreign Application Priority Data

Sep. 26, 2007 (DK) ..... 2007 01385

(51) Int. Cl.
*E21B 43/16* (2006.01)
*E21B 43/119* (2006.01)
*E21B 43/27* (2006.01)

(52) U.S. Cl. ..... 166/307; 166/250.01; 166/297

(58) Field of Classification Search ..... 166/307, 166/297, 250.01
See application file for complete search history.

(56) References Cited

U.S. PATENT DOCUMENTS

| | | | | |
|---|---|---|---|---|
| 4,714,117 | A * | 12/1987 | Dech | 166/380 |
| 5,638,904 | A * | 6/1997 | Misselbrook et al. | 166/384 |
| 6,095,245 | A * | 8/2000 | Mount | 166/276 |
| 6,497,290 | B1 * | 12/2002 | Misselbrook et al. | 166/384 |
| 6,533,038 | B2 * | 3/2003 | Venning et al. | 166/369 |
| 6,547,011 | B2 * | 4/2003 | Kilgore | 166/387 |
| 6,581,685 | B2 * | 6/2003 | Burgess et al. | 166/250.02 |
| 6,668,922 | B2 * | 12/2003 | Ziauddin et al. | 166/250.05 |
| 6,766,858 | B2 * | 7/2004 | Nguyen et al. | 166/300 |
| 7,243,723 | B2 * | 7/2007 | Surjaatmadja et al. | 166/278 |
| 7,287,592 | B2 * | 10/2007 | Surjaatmadja et al. | 166/308.1 |
| 7,401,652 | B2 * | 7/2008 | Matthews | 166/308.1 |
| 7,475,724 | B2 * | 1/2009 | Pribnow et al. | 166/250.01 |
| 2002/0153137 | A1 * | 10/2002 | Ziauddin et al. | 166/250.01 |
| 2003/0056950 | A1 * | 3/2003 | Burgess et al. | 166/250.01 |
| 2004/0206497 | A1 * | 10/2004 | Gonzalez et al. | 166/271 |
| 2005/0274522 | A1 * | 12/2005 | Surjaatmadja et al. | 166/308.1 |
| 2006/0243443 | A1 * | 11/2006 | Matthews | 166/297 |
| 2008/0015832 | A1 * | 1/2008 | Tardy | 703/10 |
| 2008/0065362 | A1 * | 3/2008 | Lee et al. | 703/10 |
| 2008/0209997 | A1 * | 9/2008 | Bailey et al. | 73/152.02 |
| 2009/0178801 | A1 * | 7/2009 | Nguyen et al. | 166/249 |
| 2009/0216508 | A1 * | 8/2009 | Dale et al. | 703/10 |
| 2009/0288824 | A1 * | 11/2009 | Fowler et al. | 166/250.17 |
| 2009/0294122 | A1 * | 12/2009 | Hansen et al. | 166/250.01 |
| 2009/0319243 | A1 * | 12/2009 | Suarez-Rivera et al. | 703/10 |

FOREIGN PATENT DOCUMENTS

| | | | |
|---|---|---|---|
| EP | 0 926 310 | A1 | 6/1999 |
| EP | 1 184 537 | A2 | 3/2002 |
| WO | WO 2005064117 | A1 * | 7/2005 |

* cited by examiner

*Primary Examiner* — Jennifer H Gay
(74) *Attorney, Agent, or Firm* — Brinks Hofer Gilson & Lione

(57) ABSTRACT

A tubular introduced into a wellbore is perforated at preselected locations after the tubular has been cemented into place. The locations of the perforations are determined by modeling inflow performance of a stimulation fluid within the formation. The inflow performance parameters include reservoir porosity, permeability, pressure, damage skin and intrusion depth, perforation diameter and penetration depth or perforation crushed zone damage and intrusion depth.

10 Claims, 8 Drawing Sheets

METHOD OF STIMULATING A WELL

RELATED APPLICATIONS

The present patent document claims the benefit of the filing date under 35 U.S.C. §119(e) of Provisional U.S. Patent Application Ser. No. 60/975,348, filed 26 Sep. 2007, and the benefit of priority to Danish Patent Application No. PA 2007 01385, filed 26 Sep. 2007, the entirety of each of which are incorporated herein by reference.

BACKGROUND

1. Technical Field

The invention relates to a method of stimulating a drilled and cemented well for use in the production of hydrocarbons from a formation, when acid or an aggressive liquid is introduced through a perforated tubular for dissolving material.

2. Related Art

In related art, a cemented tubular, such as a casing or liner, may be perforated with an even density (number of perforations per unit length), and an improvement in stimulation fluid distribution may be attempted by changing the fluid characteristics, the injection rate or injection of dissolvable materials that temporarily seals off some of the perforations.

Pre-perforated liners may have an even distribution of perforations (number of perforations per unit length), but the use of such liners may suffer from the same disadvantages.

These methods for diverting stimulation fluids are normally not able to provide an even fluid distribution over longer intervals than about 250 meters.

EP 1 184 537 describes a method of stimulating a drilled well. The stimulation fluid is discharged into the annular space surrounding a well tubing through openings configured in the wall of the tubing in the longitudinal expanse of the tubing. The placement of the holes diverts the stimulation fluid along the entire length of the well tubing. The fluid influences the material on the surface of the wellbore.

The method described in EP 1 184 537 is not applicable to tubings or tubulars which are cemented into place. Furthermore, a provision for this method is the presence of a common and open annular volume between the tubular and the wellbore.

OBJECT OF THE INVENTION

This disclosure provides methods which apply to perforation of cemented tubular systems. Diversion of the stimulation fluid may be achieved by the placement of the perforations. This disclosure further provides a method for stimulating a well having no common annular space between the tubular holes and the wellbore.

The disclosed methods may be applied to cemented and perforated liner systems with no common annular volume between the liner holes and the wellbore.

The perforations may be made using perforation guns or other perforation equipment after the liner has been cemented in place.

The disclosed methods of stimulating a wellbore may achieve a required stimulation fluid distribution in a cemented and perforated casing or liner by a case specific perforation placement design.

To make the perforating of the cemented liner more expedient, the perforations may be performed in groups or clusters.

The methods may provide a designed distribution by means of customizing the placement of each individual perforation. Sections with a high perforation density may naturally have a larger inflow of fluid than sections with a lower perforation density, if identical reservoir properties are assumed.

The perforation density used as a means of providing for a required fluid distribution may enable that sections where a high permeability of the formation is found, for example, by logging data such as permeability, porosity of the formation and pressure during drilling, sections of the wellbore may be left un-perforated or the sections may be perforated with lower perforation density. Less stimulating fluid may be injected into sections of the formation, where the formation has a high permeability.

The disclosed methods may stimulate very long cemented zones. Undesired sections in the zones may be left un-perforated by simply avoiding making perforations in the cemented liner in areas or zones where the parameters indicate that the formation will absorb too much stimulation fluid compared to other areas or zones. These methods make it possible to vary stimulation fluid injection volumes to cater for areas where a limited amount of fluid is desired and areas where a large amount is desired, all in the same zone.

These methods enable a substantial reduction in the number of zones into which a long horizontal well may be sectioned. As an example, a section with a length of 2000-2200 meters may be split into 8-10 zones according to other techniques.

The disclosed methods may reduce the number of zones from 9-10 to 1-3, with time and cost reduction in the stimulation and perforation phase as some of the benefits.

BRIEF SUMMARY

The above objects may be achieved by an embodiment of a method comprising the steps of: establishing a wellbore, introducing a tubular into the wellbore for the production of hydrocarbons or for the purpose of injection of water or other hydrocarbon displacement fluids, cementing said tubular for retaining the tubular in the wellbore, perforating the tubular at individually pre-selected locations after the tubular has been cemented in place, and stimulating the well by introducing acid or an aggressive or corrosive liquid into the formation through the perforations at individually pre-selected locations.

This method may be applicable to cemented tubulars and may also provide a highly controlled stimulation fluid distribution into the formation by customizing the placement of each of the perforations.

The pre-selected locations where the tubular is perforated may be determined by modeling and calculating the inflow performance for each perforation individually while it changes as a function of inflow volume of acid or aggressive liquid. Thereby a highly controlled distribution may be achieved.

This process may ensure that the acid or aggressive liquid when introduced through the perforated tubular for dissolving material in the formation is distributed in such a way that the acid will enter the formation with substantially equal or even flow measured along the tubular.

When the acid or aggressive fluid enters the formation it may "open" the formation to allow fluid to pass more easily from the formation and into the tubular when producing oil or from the tubular into the formation when injecting water or other displacement fluids into the formation.

The change in flow properties in the formation due to the injection of acid act as a self-perpetuating effect. The more acid flowing into the formation, the more "open" the formation will be allowing more acid to react in the formation causing further "opening" of the formation.

The inflow of acid into the formation may be controlled to ensure a substantially even distribution of acid along the tubular in relation to time.

If the acid or aggressive fluid is pumped into a tubular with pre-fabricated perforations where the perforations are placed with an even distribution along the tubular, the acid will flow into the formation where the most open structure of the formation occurs, causing the self-perpetuating effect mentioned above. A tubular with few perforations may lead the acid into the formation and not distribute the acid to all the perforations or selected perforations in the tubular.

The perforations may be performed with one or more sections along the tubular left un-perforated. The selective perforations may allow sections in the formation with undesired inflow performance can be protected from the stimulation fluid.

The perforations may be performed with distribution in clusters.

Other methods may not be able to provide an even fluid distribution over intervals longer than about 250 meters. The disclosed methods may enable both shorter and longer cemented zones to be stimulated with a desired distribution of the stimulation fluid along the interval.

The term "perforation density" may be interpreted as number of perforations per unit length.

One embodiment of the method describes stimulating a well for use in the purpose of production of hydrocarbons from a formation, or for the purpose of injection of water or other hydrocarbon displacement fluids into a formation, when acid or an aggressive or corrosive liquid is introduced through a cemented and perforated tubular for dissolving material, the method comprising the steps of:

establishing a wellbore, introducing a tubular into the wellbore for the production of hydrocarbons, cementing the tubular for retaining the tubular in the wellbore, determining locations to perforate the tubular in the wellbore by modeling the inflow performance of the acid or aggressive or corrosive liquid in the formation, based on parameters of the composition of the formation such parameters as for example reservoir porosity, permeability, pressure, damage skin and intrusion depth, perforation diameter and penetration depth, or perforation crushed zone damage and intrusion depth, perforating the tubular at pre-selected locations after the tubular has been cemented in place, and stimulating the well by introducing the acid or aggressive or corrosive liquid into the formation through the perforated tubular at pre-selected locations.

The distribution of fluid out into the formation can be varied depending on the local characteristics of the surrounding formation of a wellbore, and it may be possible to achieve a desired end distribution of fluids.

It may be possible to determine the locations to perforate the tubular in the wellbore based on other parameters in combination with one or more of the parameters such as reservoir porosity, permeability pressure, damage skin and intrusion depth, perforation diameter and penetration depth, or perforation crushed zone damage and intrusion depth.

The data of the parameters of the formation may be logged during establishment of the wellbore, either during drilling or before cementing the tubular in place. If the formation is suitably uniform, data logged from one or more previously established wellbores may be used as a basis for modeling the inflow performance of acid or aggressive liquid in the formation.

Another embodiment of the method describes stimulating a drilled and cemented well in which the pre-selected locations where the tubular is perforated are determined by calculating an inflow performance for each perforation individually while it changes as a function of inflow volume of acid or aggressive or corrosive liquid.

Thereby a highly controlled end distribution of stimulation fluids may be achieved along an interval without necessarily using any other previously known acid distribution techniques, although it may be possible to combine this method with other previously mentioned diverting methods.

These methods may achieve a more expedient method of stimulating a well and of controlling the amount of inflow volume of acid or aggressive liquid.

These methods may log data of the composition or parameters of the formation during establishment of the wellbore.

The disclosed methods may base calculations of the stimulation treatment on variations of one or more parameters of reservoir properties.

The placement of the perforation may be calculated and determined by transient fluid modeling and thereby further designing a stimulation fluid (acid) injection scheme. The determination method comprises:

calculation of inflow performance for each perforation individually while it changes as a function of volume of acid inflow in a "Matrix fluid" reservoir model, monitoring change in reservoir parameters or reservoir properties at each individual perforation, such parameters or properties including reservoir porosity, permeability, pressure, damage skin and intrusion depth, perforation diameter and penetration depth or perforation crushed zone damage and Intrusion depth, allowing variations of fluid parameters and computing an acid distribution based on a pumping schedule that includes more than one fluid type, with and without friction reducers, and correlating actual job data for post-job analysis to calculate the volume of fluids (separated into each type or stage of fluids pumped) that was injected into each perforation individually.

The above determination method may be used to control and determine the position of clusters of perforations as well as a scheme of injection of stimulation fluid and may make it possible to control the injection and distribution of stimulation fluid into pre-selected areas of the formation and thereby prevent an excessive amount of stimulation fluid being injected into areas in the formation capable of absorbing more stimulation fluid than other parts of the formation.

The stimulation fluid may comprise friction reducers.

The fluids introduced or retracted from the tubular may obtain a more easy-flowing characteristic.

The perforations may be performed with an uneven distribution along the tubular.

The perforations may be performed with distribution in clusters.

A cluster of holes is an accumulation of holes within a specific area. The perforations may be performed with distribution in clusters, the clusters having the same mutual distance.

The perforations may be performed with distribution in clusters, the clusters having different mutual distances.

Each cluster may be of a different perforation density.

Each cluster may be of an equal perforation density.

By having the above mentioned distributions of perforations, stimulation adapted to different appearance or characteristics of formations may be achieved.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The systems and methods may be better understood with reference to the following drawings and description. The elements of the figures are not necessarily to scale, emphasis instead being placed upon illustrating the principles of the system. In the figures, like-referenced numerals designate corresponding parts throughout the different views.

DETAILED DESCRIPTION OF THE PREFERRED EMBODIMENTS

Figure 1:
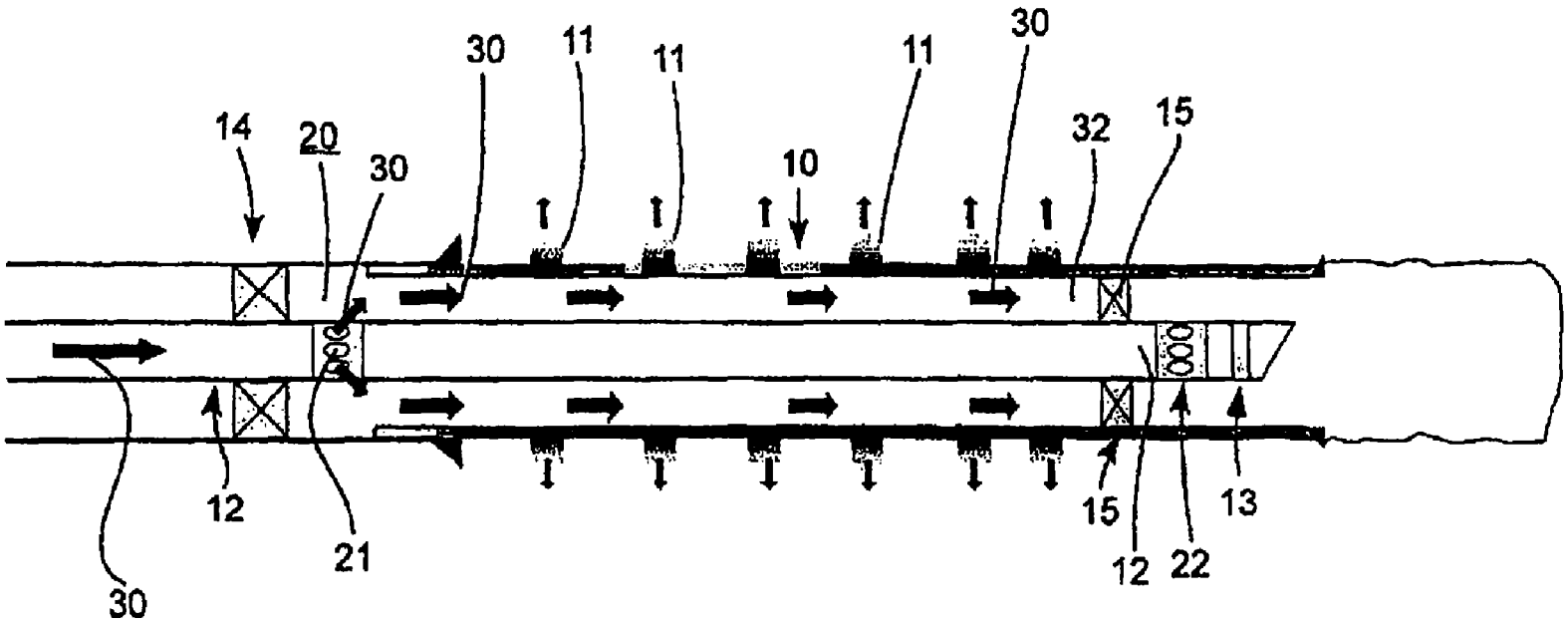
FIG. 1 schematically shows a wellbore with an introduced tubular.

FIG. 1 shows a tubular 10 for production from or for stimulating a well for use in the purpose of production of hydrocarbons from a formation 1 or from a surrounding of a formation 1.

Production of oil commonly uses tubulars in support of the well or distribution of fluid or both. The tubular 10 shown in FIG. 1 in the form of a cemented liner, is provided with perforations 11 for distribution of fluid from either the formation 1 and into the wellbore or from the wellbore and out to the formation 1.

Inside the tubular 10, a tubing 12 is provided. The tubing 12 comprises a plug 13 at a free end preventing the fluid from flowing out of the end. Outside the tubing 12 and between the tubing 12 and the wellbore and/or the cemented liner 10, packers 14, 15 are placed. The purpose of the packers 14, 15 is to provide a zone 20 between the packers 14, 15, where the zone 20 is isolated from the rest of the wellbore.

The tubing 12 is further provided with closable openings 21, situated between the packers 14, 15. Furthermore, closable openings 22 are provided at the free end, outside the packer 15. The openings 21, 22 may be opened and/or closed by opening and closing means (not shown). The openings 22 (at the right side of the drawing) are shown in their closed position, while the openings 21 situated between the packers 14, 15 are shown in their open position, thereby introducing a fluid flow from the surface of the earth that may be distributed into the annular space 32 situated between the tubings 10 and 12 as indicated by the arrows 30. To distribute the fluid flow into the surrounding formation 1, the tubular in form of the cemented liner 10 may be perforated.

Figure 2:
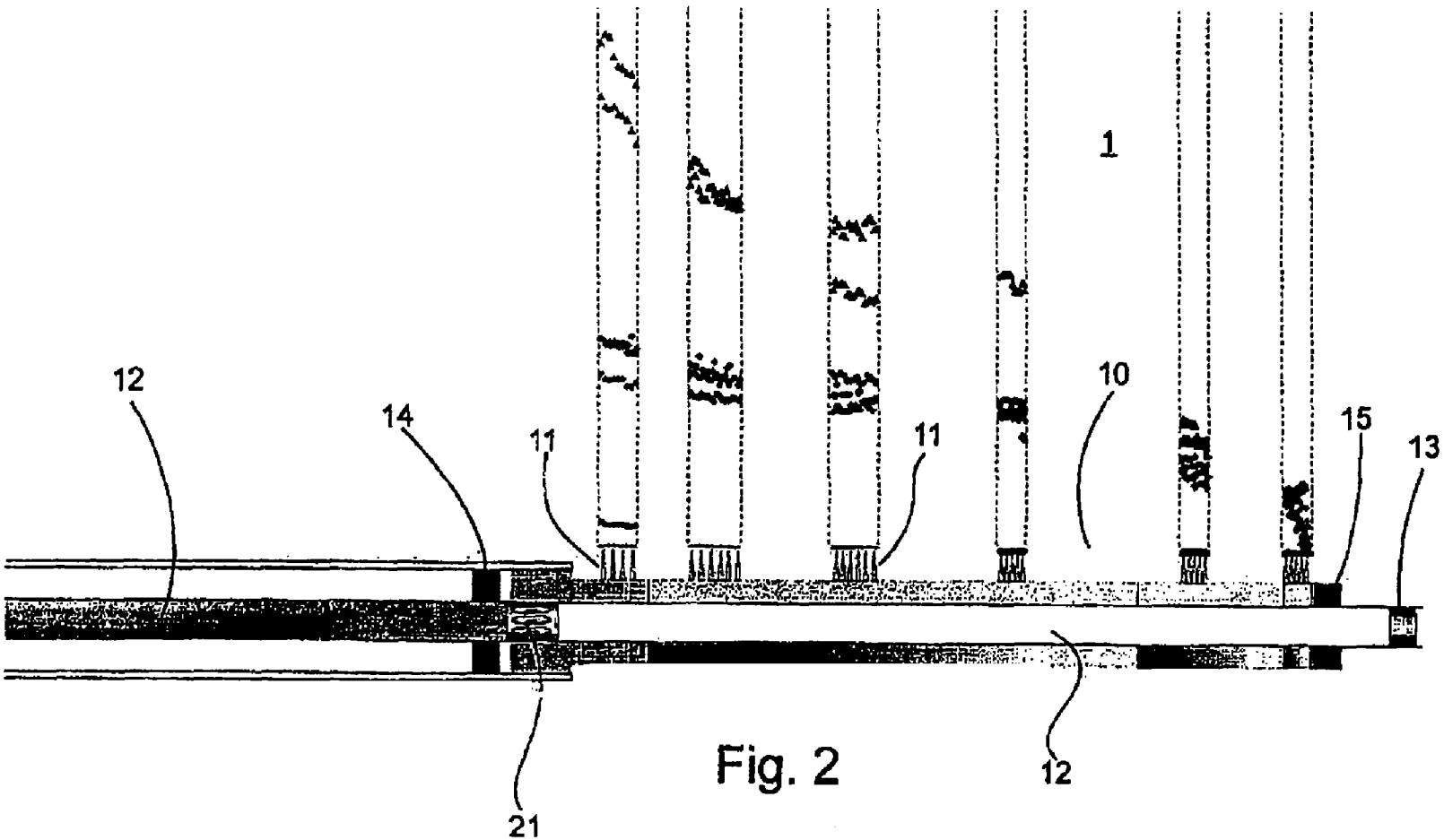
FIG. 2 schematically shows action of a wellbore with perforations in clusters of variable densities.

FIG. 2 shows an example of a design with a possible resulting stimulation and displacement fluids distribution. The design shows an example with a section with a length of about 1800-2000 meters that is perforated in six clusters 11 of variable densities. The fluid may be pumped from surface, out through an opening 21 in the tubing 12, into the space 32 around the tubing and finally through the perforations 11 made in the cemented liner 10 and into the formation 1. FIG. 2 shows the volume introduced into each perforation. The even distribution is to be understood as distribution of volume per length unit. Because of the higher perforation density in the far end of the tubular, as shown in FIG. 2, the acid volume per length unit may be the same as in the inner part of the zone. The inner zone is situated close to the opening 21 and the far end is close to the packer 15.

Other techniques have tried to achieve an even distribution of fluid into the formation 1 by changing the fluid characteristics, the injection rate or injection of dissolvable materials that temporarily seals off some of the perforations.

Figure 3:
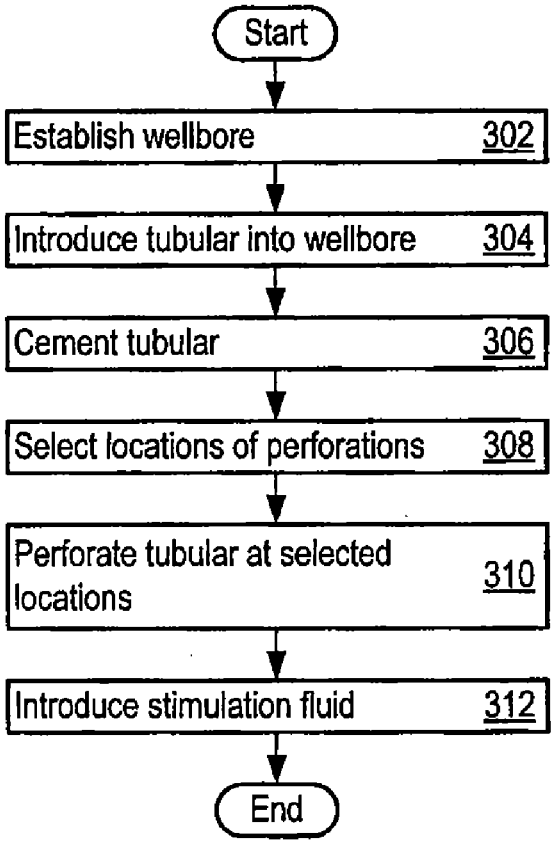
FIG. 3 shows a well stimulation flow diagram.

FIG. 3 shows a flow diagram 300 for stimulating a well. The flow diagram 300 may be realized in the system presented in FIGS. 1 and 2. A wellbore is first established (302). The establishment may be by conventional means and methods. Data of the composition of the formation may be logged during the establishment of the wellbore.

A tubular 10 is placed into the wellbore (304). The tubular may be utilized for the production of hydrocarbons or for injecting water or hydrocarbon displacement fluids into a formation. The tubular may be inserted by conventional means and methods. The tubular is cemented (306). The cementing process retains the tubular 10 in the wellbore and may be performed by conventional means and methods.

Locations along the tubular 10 are selected for perforation (308). These locations may be pre-selected according to a process modeling the inflow performance of the stimulation fluid in the formation. The locations may be selected according to a designed distribution. "Designed distribution" means a distribution of stimulation fluid into the formation 1 where the perforations 11 in the cemented tubular 10 are placed to lead the acid or aggressive liquid into the formation 1 at desired positions that are calculated or determined on the basis of, for example, information logged during drilling of the wellbore. One such process is described with respect to FIG. 4 below.

The tubular 10 is perforated at the pre-selected locations after the tubular 10 has been cemented in place (310). The perforation may be accomplished by conventional means and methods. The perforation may be performed in clusters. For example, the tubular may be perforated with a high density of perforations in small areas along the length of the tubular where the small, high-density perforated areas are adjacent to large, low-density perforation or non-perforated areas. The perforations may be evenly or unevenly distributed along the length of the tubular. Similarly, the clusters of perforations may be evenly or unevenly distributed along the length of the tubular. Each cluster may have a similar density to, the same density as, or a different density from other clusters. For example, all the clusters may have the same density. Alternatively, all the clusters may have different densities of perforations.

A stimulation fluid is introduced into the formation 1 through the perforated tubular 10 at pre-selected locations (312). The stimulation fluid may be an acid or an aggressive or corrosive liquid. The stimulation fluid may include friction reducers. The introduction of stimulation fluid into the formation 1 may stimulate the well.

Figure 4:
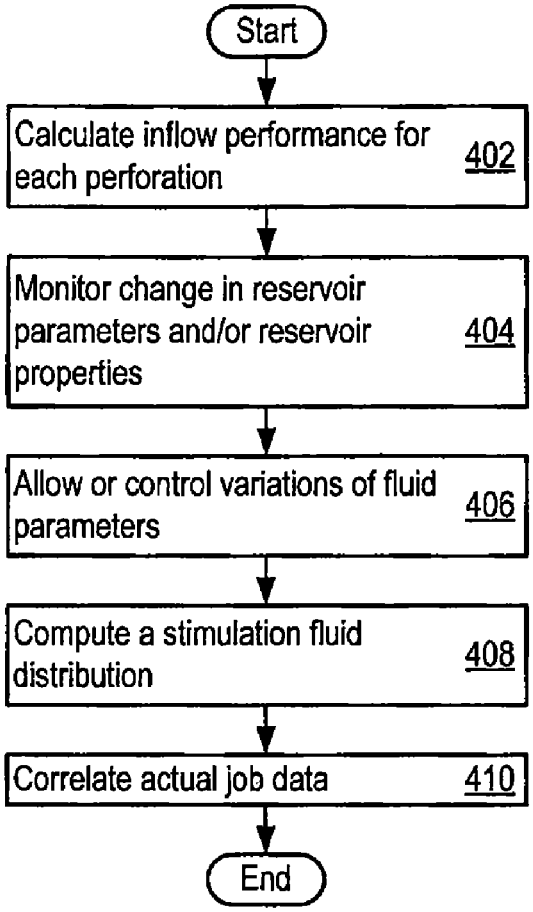
FIG. 4 shows a flow diagram for determining perforation locations.
Figure 5:
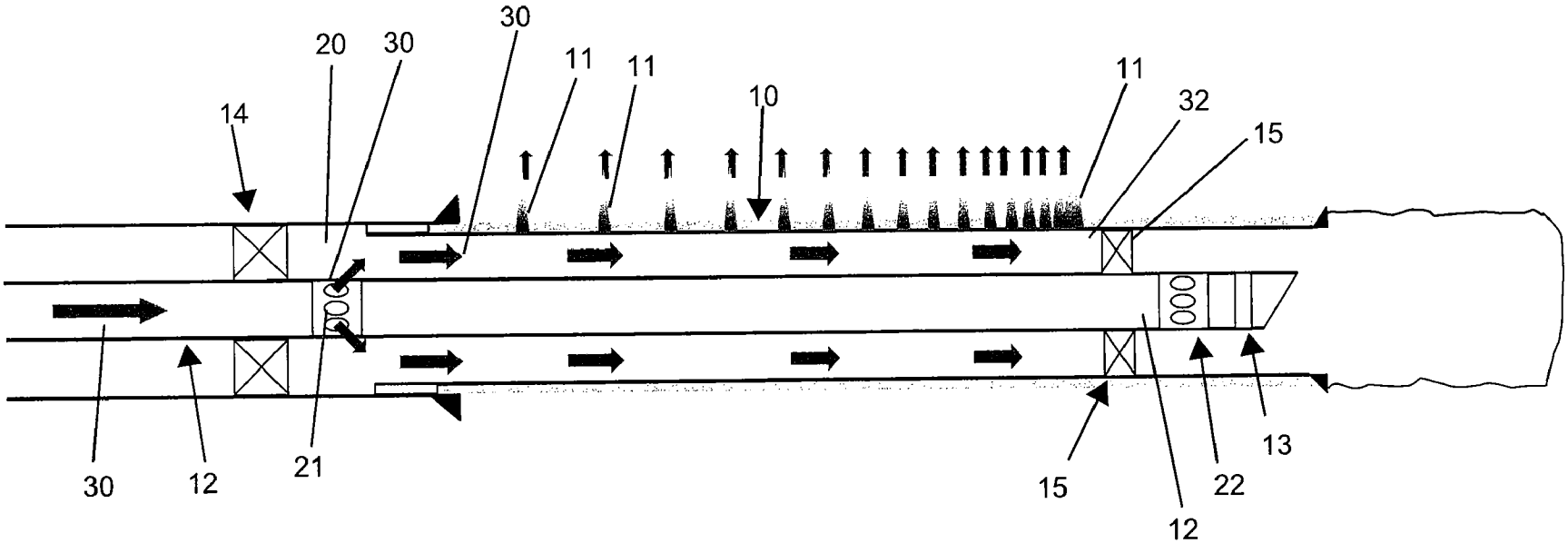
FIG. 5 schematically shows a tubular with an uneven distribution of perforations.
Figure 6:
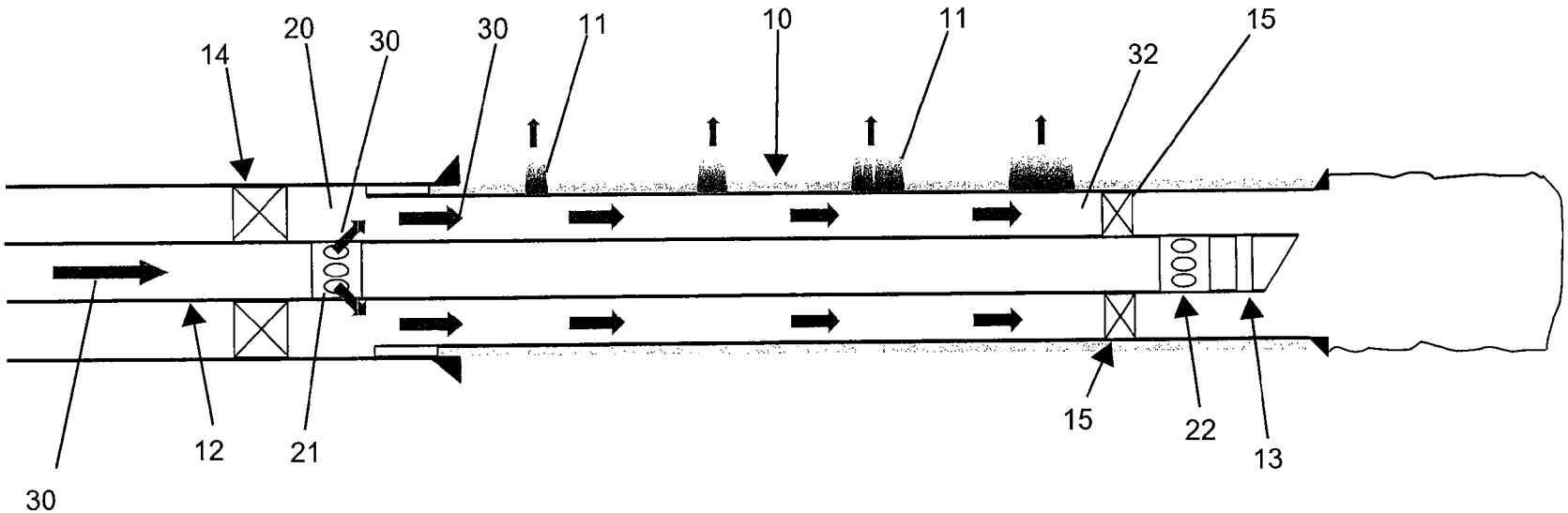
FIG. 6 schematically shows a tubular with an even distribution of perforation clusters, where each cluster has a different perforation density.
Figure 7:
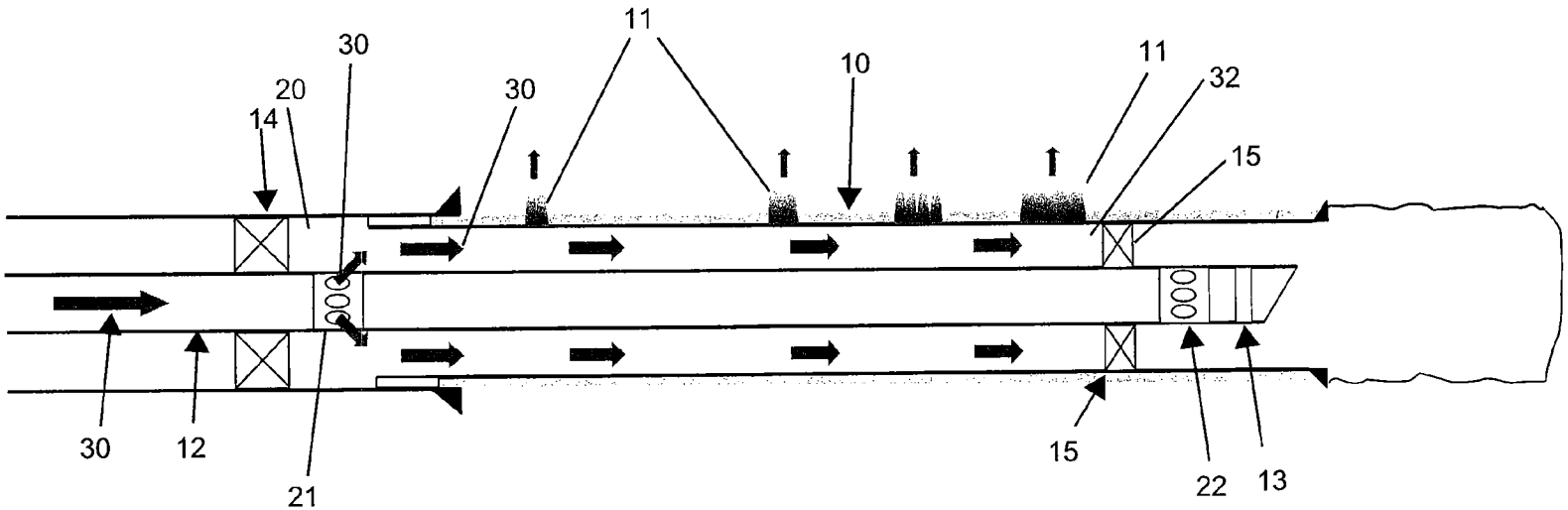
FIG. 7 schematically shows a tubular with an uneven distribution of perforation clusters, where each cluster has a different perforation density.
Figure 8:
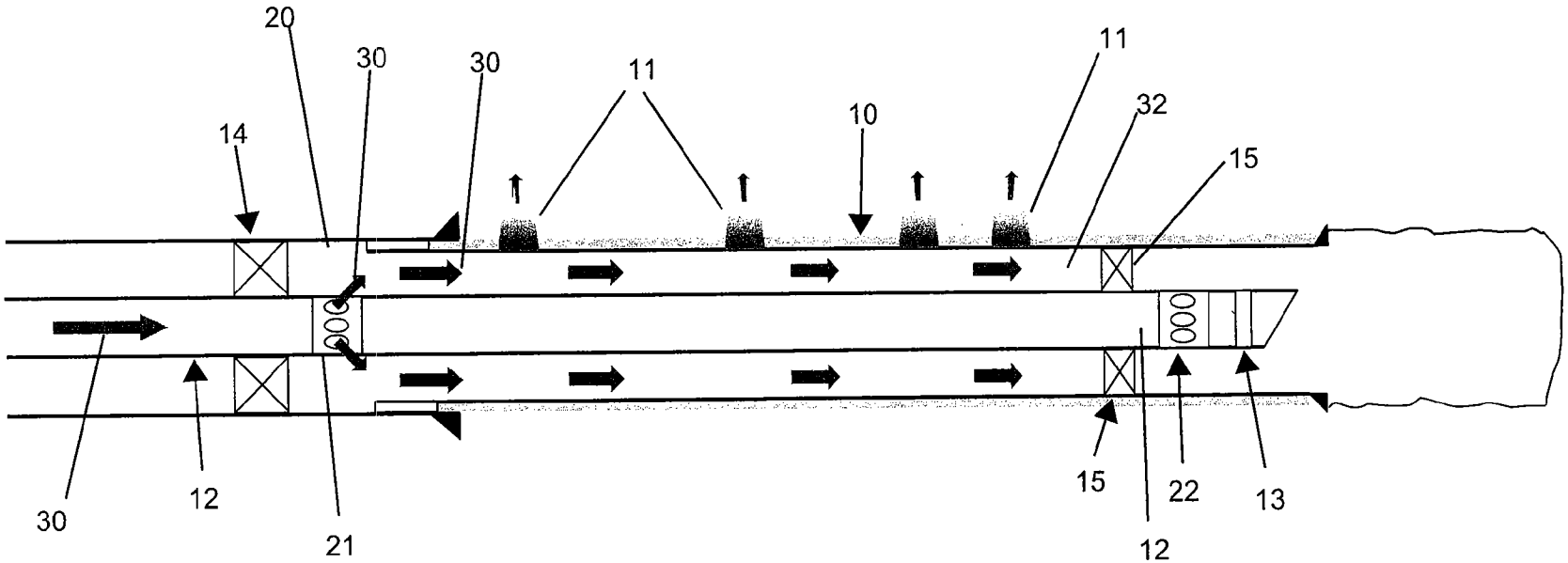
FIG. 8 schematically shows a tubular with an even distribution of perforation clusters, where each cluster has an equal perforation density.

FIG. 4 shows a flow diagram 400 for determining locations for perforating a tubular. An inflow performance is calculated for each perforation 11 (402). The calculation may be performed individually for each perforation 11. The calculation may be performed while the inflow performance changes as a function of the volume of acid or stimulation fluid inflow. The calculation may use a "Matrix fluid" reservoir model.

Changes in reservoir parameters and/or reservoir properties may be monitored (404). The changes may be monitored at each individual perforation. The reservoir parameters and/or reservoir properties may include reservoir porosity, permeability, pressure, damage skin and intrusion depth, perforation diameter and penetration depth or perforation crushed zone damage and intrusion depth.

Variations in the fluid parameters are allowed or controlled (406). The control of these variations may be in response to the changes in the reservoir parameters and/or reservoir properties. A stimulation fluid distribution is computed (408). The variations in the fluid parameters may be controlled based on the computed stimulation fluid distribution. The computation may be based on a pumping schedule for injection of the stimulation fluid into the tubular. The pumping schedule may include injection of one or more fluid types into the tubular. For example, the schedule may include injection of friction reducers. Alternatively, no friction reducers may be included, or the friction reducers may be admixed with one or more stimulation fluids.

Actual job data is correlated (410). The actual job data may be acquired during the monitoring process from (404) above. The correlation may be performed during a post-job analysis. The analysis may include a calculation of the volume of fluids separated into "type" or "stage" of the fluids pumped. The calculation may be performed for the injection into each perforation individually.

Another method describes stimulating a drilled and cemented well where calculating of the stimulation treatment includes variations of one or more parameters of reservoir properties along the zone of the formation to be stimulated.

The stimulation fluid may comprise friction reducers.

Referring to FIGS. 5-8, a desired, and possibly even, distribution of the injected acid into the formation 1 or the surroundings of the formation 1 may be ensured by performing the perforations 11 with a distribution along the tubular 10.

The desired, and possibly even, distribution may further be ensured by performing the perforations 11 with distribution in clusters.

The perforations 11 may be performed with distribution in clusters, the clusters having the same mutual distance.

The perforations 11 may be perforations with distribution in clusters, the clusters having different mutual distance.

Each cluster may be of a different perforation density.

Each cluster may be of an equal perforation density.

After stimulating the well, the well may be used to produce oil or to inject water or other hydrocarbon displacement fluids into the formation 1 or the surroundings of a formation 1 to force oil towards other oil producing areas or wells.

The methods provided above may be useful in stimulating a well for the production of hydrocarbons. These methods may also inject water or other hydrocarbon displacement fluids into a formation. The stimulation may use a stimulation fluid, such as an acid or an aggressive or corrosive liquid. The stimulation fluid may be introduced through a cemented and perforated tubular to dissolve material. The stimulation may obtain an even or designed distribution of the stimulation fluid through the cemented and perforated tubular.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. A method of stimulating a well for production of hydrocarbons from a formation when a stimulation fluid is introduced through a cemented and perforated tubular for dissolving material, the method comprising the steps of:

establishing a wellbore;

introducing a tubular into the wellbore for the production of hydrocarbons;

cementing the tubular for retaining the tubular in the wellbore;

selecting locations to perforate the tubular in the wellbore by modeling inflow performance of the stimulation fluid in the formation, based on parameters of a composition of the formation selected from the group of parameters consisting of: reservoir porosity, permeability, pressure, damage skin and intrusion depth, perforation diameter, penetration depth, or perforation crushed zone damage and intrusion depth;

perforating the tubular at the selected locations after the tubular has been cemented in place; and stimulating the well by introducing the stimulation fluid into the formation through the perforated tubular at the selected locations, wherein calculating of a stimulation treatment is based on variations of one or more parameters of reservoir properties, and wherein the selected locations are determined by transient fluid modeling and thereby further designing a stimulation fluid injection scheme, the determination method comprising:

calculating inflow performance for each perforation individually while the inflow performance changes as a function of volume of acid inflow in a "Matrix fluid" reservoir model:

monitoring change in reservoir parameters or reservoir properties at each individual perforation, the reservoir parameters or reservoir properties including a parameter selected from the group of parameters consisting of: reservoir porosity, permeability, pressure, damage skin and intrusion depth, perforation diameter and penetration depth, or perforation crushed zone damage and intrusion depth;

allowing variations of fluid parameters and computing a stimulation fluid distribution based on a pumping schedule that includes more than one fluid type with and without friction reducers; and correlating actual job data for post-job analysis in order to calculate the volume of fluids separated into each type or stage of fluids pumped that was injected into each perforation individually.

2. The method of claim 1, wherein data of the composition of the formation is logged during the establishment of the wellbore.

3. The method of claim 1, wherein the stimulation fluid comprises friction reducers.

4. The method of claim 1, wherein the perforations are performed with an uneven distribution along the tubular.

5. The method of claim 4, wherein the perforations are performed with distribution in clusters, the clusters having a same mutual distance.

6. The method of claim 4, wherein the perforations are performed with distribution in clusters, the clusters having different mutual distances.

7. The method of claim 1, wherein the perforations are performed with distribution in clusters.

8. The method of claim 7, wherein each cluster comprises a different perforation density.

9. The method of claim 7, wherein each cluster comprises an equal perforation density.

10. A method of stimulating a well for production of hydrocarbons from a formation when a stimulation fluid is introduced through a cemented and perforated tubular for dissolving material, the method comprising the steps of:

establishing a wellbore;

introducing a tubular into the wellbore for the production of hydrocarbons;

cementing the tubular for retaining the tubular in the wellbore;

selecting locations to perforate the tubular in the wellbore by modeling inflow performance of the stimulation fluid in the formation, based on parameters of a composition of the formation selected from the group of parameters consisting of: reservoir porosity, permeability, pressure, damage skin and intrusion depth, perforation diameter, penetration depth, or perforation crushed zone damage and intrusion depth;

perforating the tubular at the selected locations after the tubular has been cemented in place; and stimulating the well by introducing the stimulation fluid into the formation through the perforated tubular at the selected locations, wherein calculating of a stimulation treatment is based on variations of one or more parameters of reservoir properties, and wherein the selected locations are determined by transient fluid modeling and thereby further designing a stimulation fluid injection scheme, the determination method comprising:

calculating inflow performance for each perforation individually while the inflow performance changes as a function of volume of acid inflow in a "Matrix fluid" reservoir model;

monitoring change in reservoir parameters or reservoir properties at each individual perforation, the reservoir parameters or reservoir properties including a parameter selected from the group of parameters consisting of: reservoir porosity, permeability, pressure, damage skin and intrusion depth, perforation diameter and penetration depth, or perforation crushed zone damage and intrusion depth; and allowing variations of fluid parameters and computing a stimulation fluid distribution based on a pumping schedule that includes more than one fluid type with and without friction reducers.

* * * * *